US010876810B1

(12) United States Patent
Pineda et al.

(10) Patent No.: US 10,876,810 B1
(45) Date of Patent: Dec. 29, 2020

(54) PAINTBALL POD AND LOADER

(71) Applicant: HK Army Inc., Gardena, CA (US)

(72) Inventors: Jason Jeremiah Pineda, Gardena, CA (US); Brandon Karl Trostrud, Gardena, CA (US)

(73) Assignee: HK Army Inc., Gardena, CA (US)

( * ) Notice: Subject to any disclaimer, the term of this patent is extended or adjusted under 35 U.S.C. 154(b) by 0 days.

(21) Appl. No.: 16/992,746

(22) Filed: Aug. 13, 2020

Related U.S. Application Data

(60) Provisional application No. 62/894,705, filed on Aug. 31, 2019.

(51) Int. Cl.
*F41B 11/52* (2013.01)
*F41A 9/01* (2006.01)

(52) U.S. Cl.
CPC ..... *F41B 11/52* (2013.01); *F41A 9/01* (2013.01)

(58) Field of Classification Search
CPC ..... F41B 11/52; F41A 9/01; F41A 9/82
USPC ..... 124/45, 49, 50
See application file for complete search history.

(56) References Cited

U.S. PATENT DOCUMENTS 3,058,483 A * 10/1962 Douglass ..... F16K 3/03 137/315.07
3,263,664 A * 8/1966 Bauer ..... F41A 9/83 124/49
5,809,983 A * 9/1998 Stoneking ..... F41B 11/52 124/45
6,015,058 A * 1/2000 Parks ..... F41B 11/52 220/229
6,055,975 A * 5/2000 Gallagher ..... F41A 9/01 124/49
6,234,157 B1 * 5/2001 Parks ..... F41B 11/52 124/45
6,273,079 B1 * 8/2001 Jzn ..... F41B 11/52 124/45
6,722,355 B1 * 4/2004 Andrews, Jr. ..... F41B 11/52 124/49
7,000,603 B1 * 2/2006 Steenbeke ..... F41A 9/83 124/45
7,077,118 B2 * 7/2006 Lewis ..... F41B 11/50 124/45
7,216,641 B2 * 5/2007 Friesen ..... F41B 11/52 124/45
7,255,012 B2 * 8/2007 Hedtke ..... F16K 3/03 73/861.61

(Continued)

*Primary Examiner* — Alexander R Niconovich
(74) *Attorney, Agent, or Firm* — Knobbe, Martens, Olson & Bear, LLP

(57) ABSTRACT

A paintball pod for filling a hopper of a paintball gun with paintballs includes an annular collar with a valve that selectively closes an outlet opening of the pod. An alignment ring is connected around the hopper inlet. When the pod and hopper inlet are operatively aligned, the valve opens (automatically) and paintballs are dispensed from the pod into the hopper. The collar also includes a ratchet member connected to the valve and lock member(s) (e.g., magnetic lock(s)) that engages the ratchet member to retain the valve in a closed position. When the collar is operatively aligned with the alignment ring a magnetic force is applied by the alignment ring on the lock member, causing the lock member to retract and allowing the ratchet member to rotate to a home position and open the valve member.

20 Claims, 15 Drawing Sheets

(56) References Cited

U.S. PATENT DOCUMENTS

| | | | | |
|---|---|---|---|---|
| 7,270,120 | B2 * | 9/2007 | Broersma | F41B 11/55 124/45 |
| 7,431,026 | B2 * | 10/2008 | Ho | F41B 11/52 124/49 |
| 7,779,825 | B2 * | 8/2010 | Estrate | F41A 9/63 124/49 |
| 7,975,681 | B2 * | 7/2011 | Handel | F41B 11/55 124/49 |
| 8,302,586 | B2 * | 11/2012 | Isabelle | F41B 11/57 124/49 |
| 9,163,899 | B2 * | 10/2015 | Evans | F41B 11/70 |
| 9,702,646 | B2 * | 7/2017 | Giaretta | F41B 11/89 |
| 9,772,159 | B2 * | 9/2017 | Isabelle | F42B 39/26 |
| 2005/0121015 | A1 * | 6/2005 | Postorivo, Jr. | F41B 11/52 124/49 |
| 2007/0062509 | A1 | 3/2007 | Campo et al. | |

* cited by examiner

PAINTBALL POD AND LOADER

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present invention relates to a device for loading paintballs into a paintball loader (e.g., hopper), and more particularly to an improved pod enabling one-handed filling of the loader.

Description of the Related Art

Paintball guns (e.g., paintball markers) have a hopper (e.g., loader) coupled thereto that feeds paintballs into the marker. As the paintballs are fired from the gun, the hopper continuously feeds paintballs into the marker until empty. The hopper can be refilled with additional paintballs that can be delivered from a tubular pod into the hopper. Players can carry multiple tubular pods filled with paintballs on a belt or harness for refilling the hopper during a paintball competition.

In operation, the player removes the pod from their harness, opens the lid of the pod, opens the lid of the hopper, and pours the paintballs from the pod into the hopper before continuing play. Most generic pod designs include a lid that the user must flip open before pouring the paintballs into the hopper. Similarly, the inlet of the hopper typically has a similar spring loaded lid that snaps shut during play and which must be opened so that paintballs can be poured therein. Accordingly, reloading the hopper with paintballs from conventional pods can be cumbersome and time consuming, requiring fine motor skills in opening the lid of the hopper and pod and necessarily takes the players focus away from potential threats around them when done during a game. Another drawback of existing pods is that the user can unintentionally open the pod or hopper lid. Therefore, there is a greater risk of accidentally opening the pods and spilling paintballs.

Additionally, conventional pods with push button lids and sleeve pod designs require a user to manually engage the push button or sleeve to facilitate filling of the hoper. Such systems also prompt players to take additional steps in preparing their equipment for quick reloading and therefore necessarily require additional time and effort before a game begins. For example, many players set up their gear with the push button lids pointed in specific directions to aid in finger placement. Although this can be effective it is inconsistent and requires an additional step in setup. Additionally, if a player cannot find the button they have to move their focus from the opposing players to find the push button.

SUMMARY

In accordance with one aspect of the disclosure, there is a need for a paintball pod and hopper system that speeds up the process of reloading the hopper with paintballs without requiring fine motor skills or increased attention from the user to the refilling process, in order to reduce the chance that a player will be eliminated because they are focused on reloading the hopper rather than play.

In accordance with another aspect of the disclosure, an improved paintball pod is provided that can be operated with one hand to deliver paintballs from the pod to a hopper (e.g., by generally aligning the pod with the opening in the hopper to deliver the paintballs from the pod into the hopper), and that reduces the risk that an unintentional opening of the pod will cause spillage of the paintballs in addition to reducing the steps necessary to prepare and complete the reloading process In accordance with another aspect of the disclosure, an improved paintball pod is provided with a switch that can be actuated to open the pod to allow delivery of the paintballs inside the pod into the hopper. Optionally, the switch is automatically actuated when the pod is aligned with the opening of the hopper, opening the end of the pod to allow delivery of the paintballs into the hopper (e.g., allowing the paintballs to be gravity-fed into the hopper). Alternatively, the switch can be actuated by a user prior to aligning the pod with the opening of the hopper. The pod can be handled with one hand by the user to refill the hopper with paintballs.

In accordance with another aspect of the disclosure, an improved paintball pod is provided. The pod includes a ratchet system that inhibits (e.g. prevents) the pod from inadvertently opening (e.g., when jarred, dropped or otherwise handled).

In accordance with another aspect of the disclosure, an improved paintball filling system is provided. The paintball filling system at pod and a hopper that allows players to reload paintballs quickly and efficiently without necessarily requiring two hands or focusing attention on the hopper inlet, allowing players to stay focused on play rather than the reloading operation. The system includes a paintball filling pod container with an annular collar around its outlet and a complimentary alignment ring attached around the inlet of a paintball hopper or loader. The annular collar has a valve with a ratchet mechanism. The valve can be biased (e.g. spring-loaded, such as via a torsion spring) in the open position (e.g., allowing the end of the pod to be open to allow delivery of paintballs therefrom), and the ratchet locks the valve in the closed position (e.g., to close the end of the pod and disallow delivery of paintballs therefrom). The ratchet mechanism has a catch that is in biased engagement with the teeth of the ratchet so the catch must be disengaged from the teeth for the valve to open. The alignment ring attached to the opening of the hopper includes a release to the ratchet mechanism. In one implementation, when the annular collar is placed proximate (e.g., engages, contacts) the alignment ring, the release actuates the catch to disengage from the teeth so that the valve is free to move from its closed position to its open position.

In accordance with another aspect of the disclosure, the paintball pod described herein has a valve covering the outlet of the pod that is an iris diaphragm valve. The iris diaphragm valve can be made of a flexible material (e.g., an elastic material, latex). The catch of the ratchet mechanism of the pod can be an array of magnets on the teeth side of the ratchet with a ferrous plate on the other side of the ratchet. The ratchet and catch are both situated within a housing of the annular collar attached to an end of the pod, and the array of magnets are drawn toward the ferrous plate (or other ferromagnetic material) and pulled into contact with the teeth. Generally, the magnetic catch is biased into engagement with the teeth of the ratchet mechanism; accordingly, it is possible for the ratchet to be made from a magnetic material so that the magnets are attracted directly to the ratchet, and it is possible for the magnetic catch to be a single magnet rather than an array of magnets. The alignment ring has an array of magnets of opposite polarity to the array of magnets in the housing of the annular collar so that when the annular collar is placed near the alignment ring, the magnetic forces between the collar and the ring hold the collar to the ring, and the magnetic catch in the annular collar is pulled toward the alignment ring and away from the teeth. With the catch disengaged from the teeth, the valve moves to its open position (e.g., via a spring force from a spring that biases the valve toward the open position), and paintballs in the pod can be gravity-fed through the outlet of the pod and through the inlet of the hopper into the interior space of the hopper's body. In one implementation, the ratchet mechanism keeps the valve closed until a continuous magnetic force, supplied by the magnetic alignment ring, disengages the magnetic catch, and thereby ensures that the valve would not fully open as the pod is jostled or dropped. In operation, the locking magnet must move past each of the multiple ratchet teeth to fully open the valve. Accordingly, if the pod is jostled or dropped and the magnetic catch is partially dislodged from one tooth, the magnetic force pulling the catch toward the ratchet teeth will reengage the catch with the next ratchet tooth so that the valve would remain mostly closed and would not open.

To prepare the pod for use, the player fills the pod with paintballs and rotates the valve to the closed position via the ratchet mechanism. When the player wants to reload their hopper, they position the valve of the pod over the inlet of the hopper and the magnets of the alignment ring are attracted to the complementary magnets within the annular collar which automatically align the pod and hopper inlet. Simultaneously, the magnet array within the alignment ring moves the locking magnet into the unlocked position where the magnet is pulled away from the ratchet teeth and the valve is biased (e.g., by a spring, such as a torsion spring) into the open position, thus allowing the paintballs to pass from the pod and enter the hopper.

DETAILED DESCRIPTION

Figure 1A:
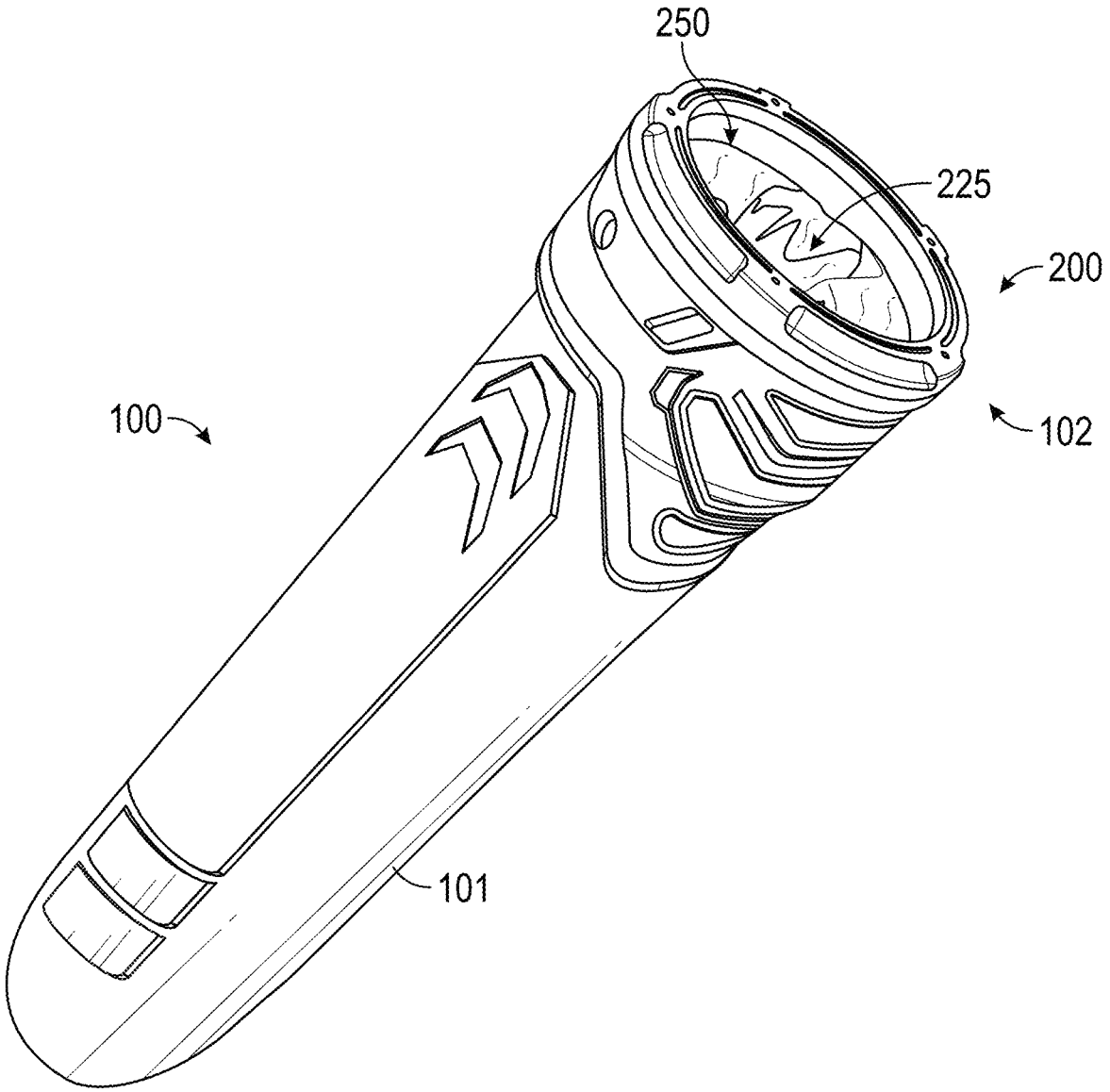
FIG. 1A is a perspective view of a pod in a first orientation.
Figure 1B:
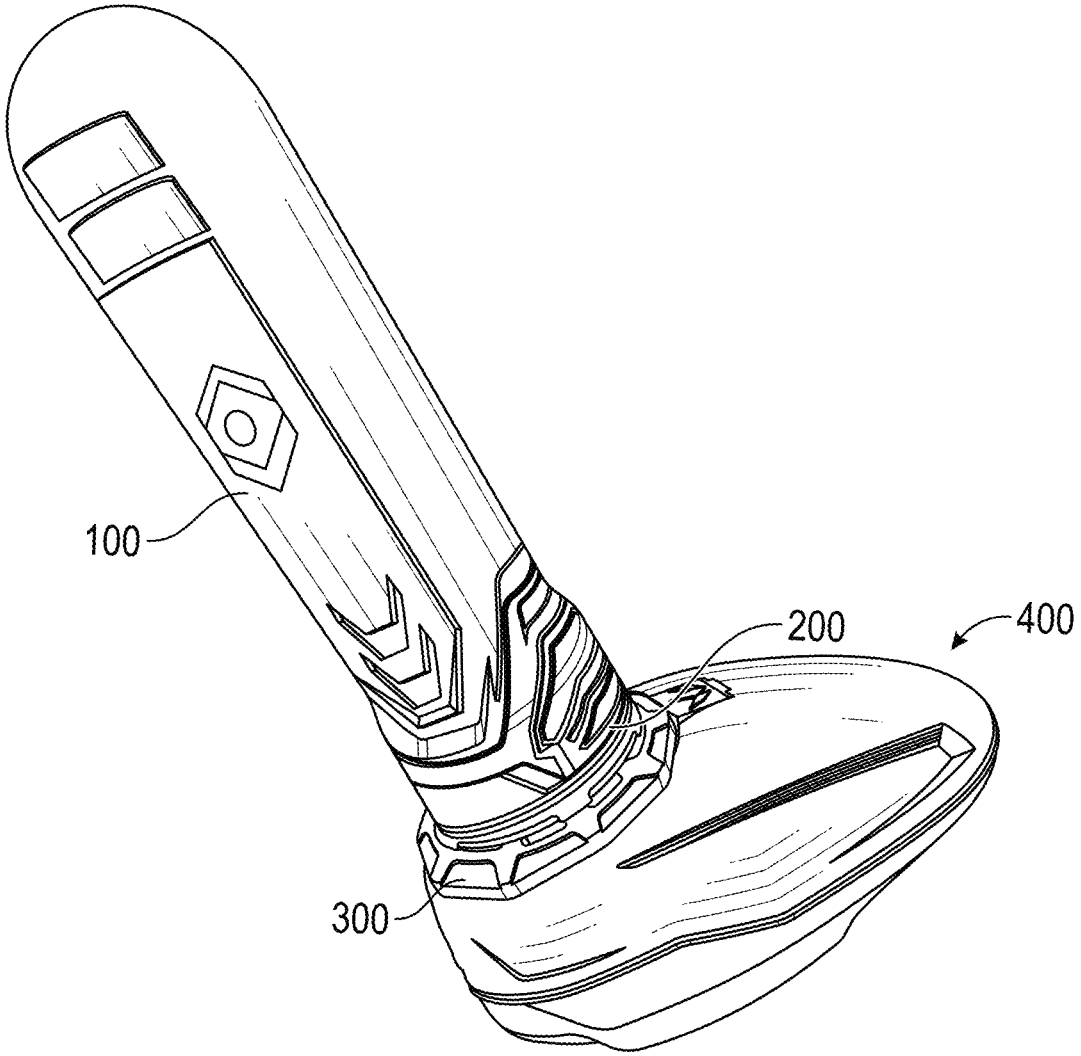
FIG. 1B is a perspective view of the pod of FIG. 1A in a second orientation and adjacent a hopper.

The filling system described herein allows players to reload paintballs as quickly and efficiently as possible into a loader or hopper. In one implementation, shown in FIGS. 1A-4D, the system includes a paintball pod 100 container having an outlet opening 102 and an annular collar 200 coupled to the paintball pod 100 at or around the outlet opening 102. The annular collar 200 can have an iris diaphragm valve 250 actuatable to cover (e.g., close) or uncover (e.g., open) with a flexible (e.g., elastic) membrane 255 the outlet opening 102 of the pod container 100. The membrane 255 does not protrude from the collar 200 (e.g., from a surface of the collar 200 that faces the hopper 400 when the paintball pod 100 is aligned with the opening 402 of the hopper 400). The flexible membrane 255 can extend (e.g., along a plane) generally transverse (e.g., perpendicular) to the axis of the paintball pod 100. In one implementation, the system also includes an alignment ring 300 that defines an opening 302 and is attached around the inlet 402 of a paintball hopper or loader 400. The alignment ring 300 can have multiple pieces and can optionally include a cover 303 and a base 304.

The annular collar 200 includes a housing 210 that retains a ratchet member 220, optionally includes one or more metal (e.g., ferrite) plates 230 on one side of the ratchet member 220, one or more magnets 240 on an opposite side of the ratchet member 220, and optionally includes one or more springs 260. The ratchet member 220 is therefore interposed (e.g., axially between) the metal plate(s) 230 and the magnet(s) 240. The ratchet member 220 can rotate about a central axis of the collar 200. In one implementation, the ratchet member 220 is coupled via the spring(s) 260 to the housing 210, which bias the ratchet member 220 into a home position or orientation in which the valve 250 is open (e.g., the iris diaphragm 255 is open to uncover the outlet opening 102 of the pod 100). In other implementations the spring(s) 260 are excluded and the ratchet member 220 is biased into the home position by the tension force applied by the elastic membrane 255 of the valve 250, where the tension force applied by the elastic membrane 255 increases as the valve 250 is moved from the open position to the closed position (e.g., when the ratchet member 220 is rotated in one direction D1, as shown in FIG. 3F). When the valve 250 is unlocked (e.g., when the magnet(s) 240 move away from the ratchet member 220, as shown in FIG. 4C), the tension force in the elastic membrane 255 causes (e.g., pulls) the ratchet member 220 to rotate in an opposite direction D2 (see FIG. 3G) toward a home position, allowing the membrane 255 to define an opening (e.g., open the valve 250) via which paintballs in the pod 100 can be dispensed.

The one or more magnets 240 (e.g., locking magnet catch) are movably disposed in openings 212 in the housing 210 and can move (e.g., slide axially within the openings 212 in a direction parallel to a central axis of the collar 200) between a first position 242 adjacent the ratchet member 220 and a second position 244 spaced apart from the ratchet member 220. The magnet(s) 240 are biased into the first position 242 (e.g., in contact with the ratchet member 220) via a magnetic force exerted between the metal plate(s) 230 and the magnet(s) 240 on opposite sides of the ratchet member 220, such that the magnet(s) 240 engage (e.g., catch) one or more teeth 222 of the ratchet member 220 (e.g., as the ratchet member 220 is rotated relative to the housing 210, such as to close the valve 250). As further described below, the magnet(s) 240 can move to the second position 244 (e.g., when the pod 100 is aligned with the hopper 400 so the collar 200 is aligned with the alignment ring 300) such that the magnet(s) 240 are spaced apart from the ratchet member 220 and disengage or do not engage the one or more teeth 222 of the ratchet member 220, allowing the spring(s) 260, or tension force applied by the elastic membrane 255, to move (e.g., pull, push) the ratchet member 220 to the home position where the valve 250 is open.

The iris diaphragm valve 250 can include one or more pieces (e.g., a cylindrical piece, an annular piece, a single membrane) of flexible material 255 (e.g., latex, rubber, an elastic material), one end of which is attached to the housing 210 and another end of which is attached to the ratchet member 220. The ratchet member 220 inhibits (e.g., prevents) the valve 250 from unintentionally opening once the ratchet member 220 has been moved from a home position where the valve 250 is open to an end position where the valve 250 is closed. As the ratchet member 220 is rotated from the home position to the end position, the one or more teeth 222 (e.g., inclined ramps) pass under and past the magnet(s) 240. Once the ratchet member 220 reaches the end position, the magnet(s) 240 engage (e.g., catch) the teeth 222 (e.g., contact or bear against the raised portion of the teeth 222), inhibiting (e.g., preventing) the ratchet member 220 to be moved back to the home position (e.g., by a spring force exerted by the spring(s) 260 on the ratchet member 220, by a tension force applied by the elastic membrane 255 on the ratchet member 220). Therefore, the ratchet member 220 inhibits (e.g., prevents) the valve 250 from opening when the pod is not positioned proximate to (e.g., over, adjacent to, in contact with) the inlet 402 of the hopper 400 in the filling orientation, such as when the pod 100 is being carried in a harness or bag or is dropped.

In operation, the player removes the pod 100 from their harness (not shown). In one example, the player generally (e.g., loosely) aligns the pod 100 over the inlet 402 of the hopper 400 (e.g., loosely aligns the annular collar 200 on top of the alignment ring 300 that is attached to the hopper 400). Once the annular collar 200 of the pod 100 is in close proximity to (e.g., proximate to, adjacent to, in contact with) the alignment ring 300, one or more magnets 310 in, on or of the alignment ring 300 (e.g., in the base 304 of the alignment ring 300) snap (e.g., position, via a magnetic force) the annular collar 200 into alignment with the inlet 402 of the hopper 400. As the pod 100 and hopper 400 align, the one or more (e.g., a plurality of, an array of) magnets 310 in the alignment ring 300 exert an attractive magnetic force on the magnet(s) 240 in the housing 210 of the collar 200 (e.g., a magnetic force larger than a magnetic force between the magnet(s) 240 and metal plate(s) 230), causing the magnet(s) 240 to move to the second position 244 spaced apart from the ratchet member 220, allowing the spring(s) 260, or tension force applied by the elastic membrane 255, to move (e.g., pull) the ratchet member 220 to the home position and open the valve 250. Accordingly, the outlet opening 102 is at least partially uncovered or opened by the valve 250 and paintballs are gravity-fed from the pod 100 into the hopper 400 through the outlet opening 102 of the pod 100. Once the pod 100 is empty, the user can move the pod 100 away from over the inlet opening 402 of the hopper 400 (e.g., disengaged from the alignment ring 300) and reloading of the hopper 400 with paintballs is complete.

The pod outlet 102 and collar 200 are preferably made in accord with the current dimensions of flip lids for pods and hoppers that are currently used and known by persons having an ordinary skill in the art of paintball. The annular collar 200 is tabbed, which allows for the swapping of the valve on to different containers if the pod should break. Preferably, the valve 250 consists of an elastic MUCON™ iris valve body (e.g., elastic membrane 255) attached around its perimeter to the ratchet member 220 within the annular collar 200. Accordingly, the ratchet member 220 is held within the housing 210 in the annular collar 200 and has multiple ratchet teeth 222 with a catch (e.g., magnet(s) 240), along with a ferrous material (e.g., metal plate(s) 230) under the ratchet teeth 222 in one implementation. The catch can be a locking magnet (e.g., magnet(s) 240) that moves up and down inside the housing 210 of the annular collar 200 between an unlocked (e.g., second position 244) and locked position (e.g., first position 242). To aid in alignment, an array of magnets (e.g., magnet(s) 240) are positioned within the collar 200 of the valve which interact with a corresponding array of magnets (e.g., magnet(s) 310) within the alignment ring 300.

Figure 2A:
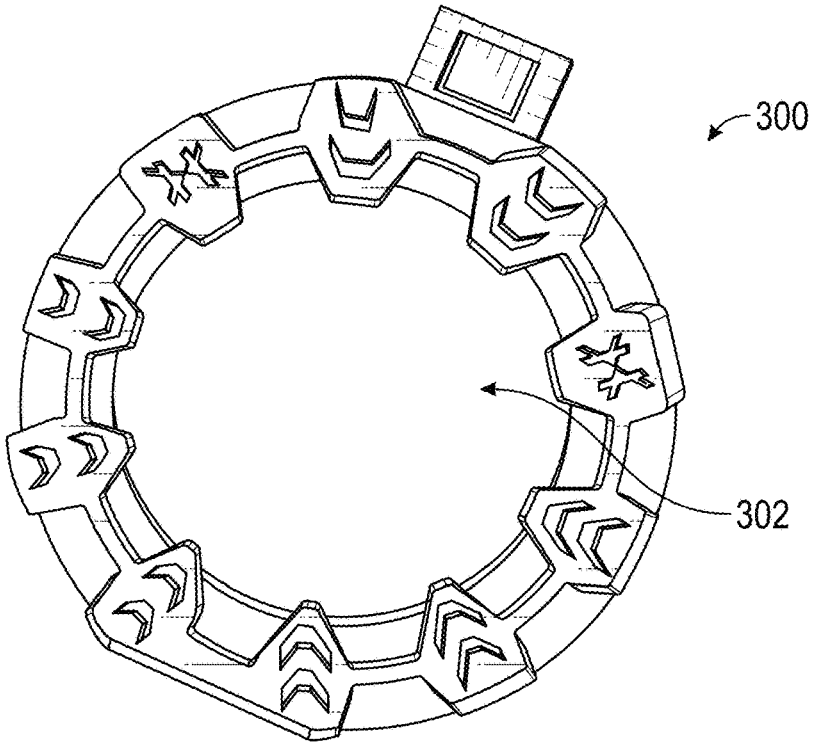
FIG. 2A is a perspective view of an alignment ring.
Figure 2B:
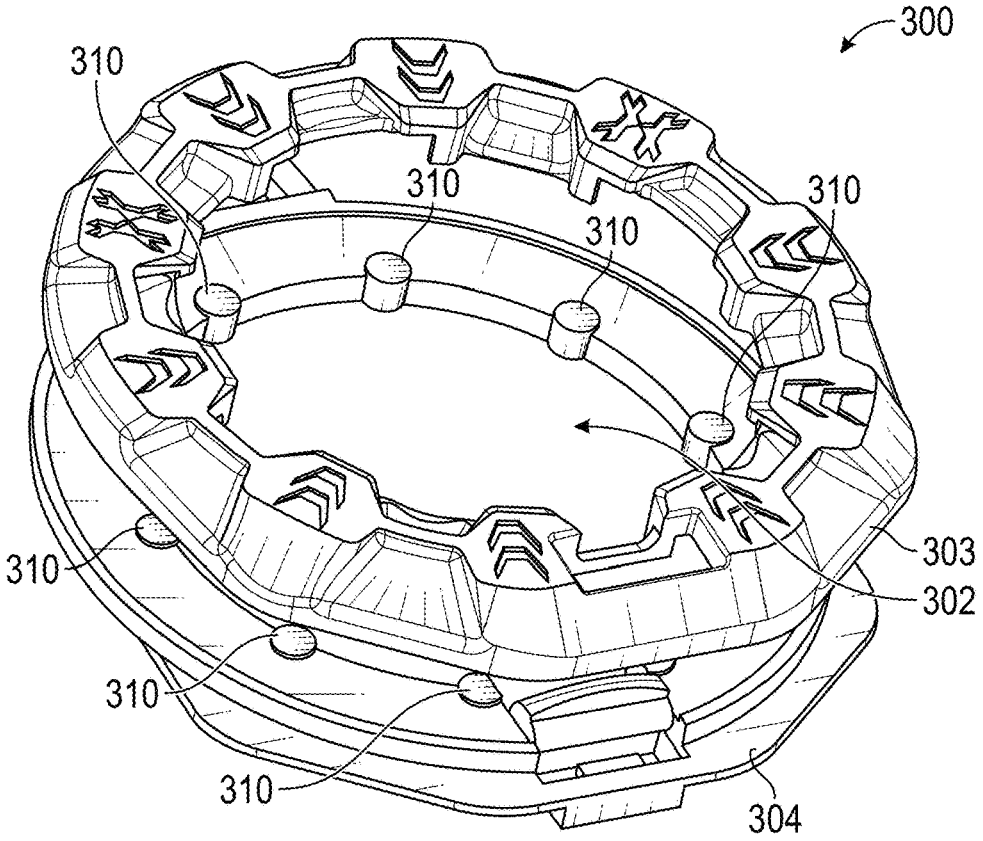
FIG. 2B is an exploded view of the alignment ring of FIG. 2A.
Figure 2C:
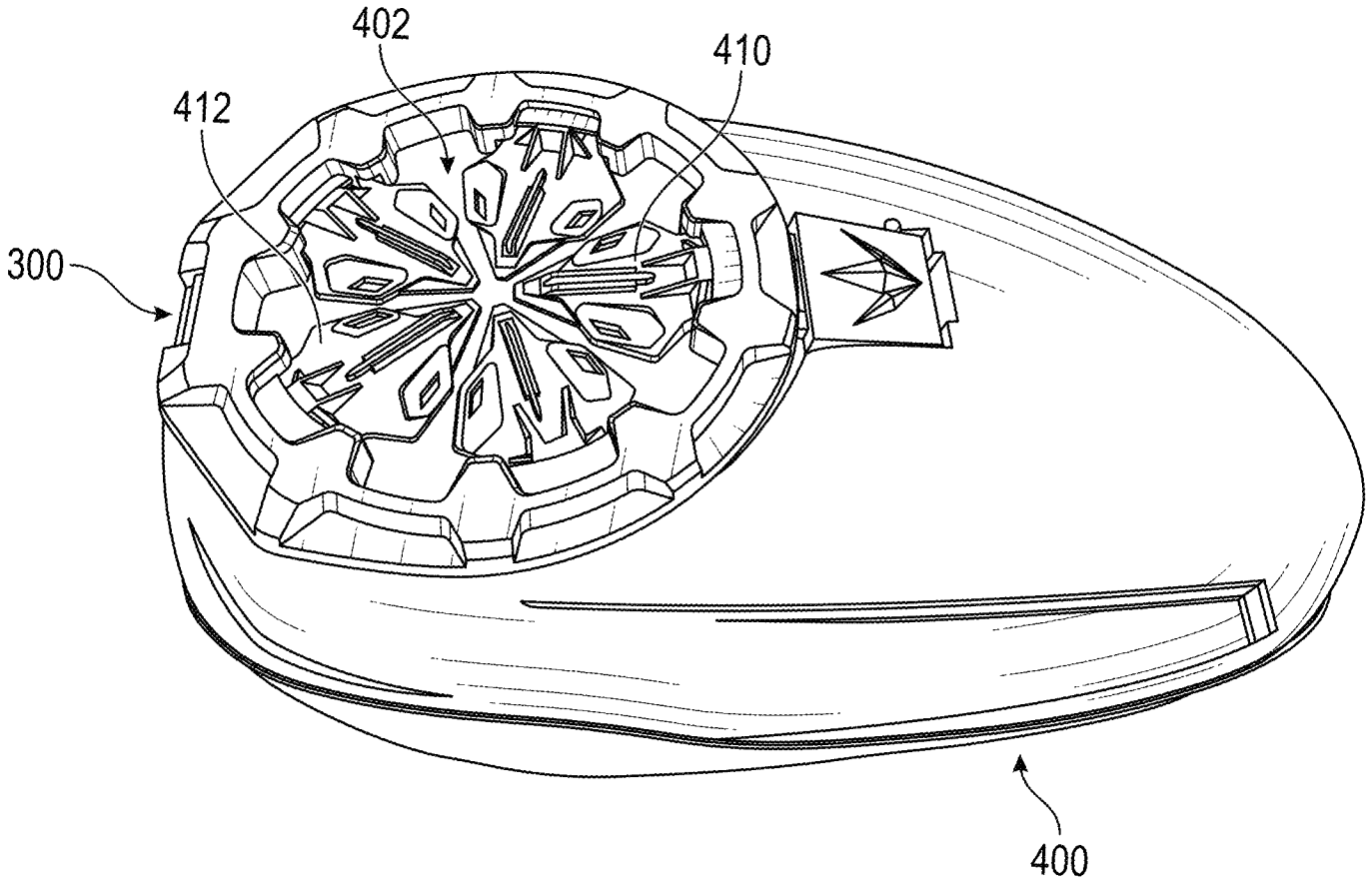
FIG. 2C is a perspective view of the alignment ring of FIG. 2A attached to a hopper.

The filling system particularly includes a paintball hopper 400 with an inlet 402 having an alignment ring 300 positioned around the hopper inlet 402, such as shown in FIG. 2C. The alignment ring 300 can be permanently affixed to the hopper 400, integrated with the hopper 400, or removable. Additionally, the ring 300 is preferably sized to mimic the design of the hopper inlet 402. Generally, the ring 300 will be annular and traverse the perimeter of the circular inlet 402 but it will be appreciated by those having an ordinary skill in the art that the alignment ring 300 and the annular collar 200 may take other shapes, such as a square or rectangle. The alignment ring 300 also has an array of magnets 310 that operatively engage the annular collar 200 of the pod 100 as described below. As with the alignment ring 300, the shape of the array of magnets 310 is preferably circular but it will be appreciated that the magnets 310 can have a shape that mimics the shape of the hopper inlet 402.

To prevent spillage of paintballs out of the hopper 400 after filling is complete, a one way valve 410 (e.g., having a plurality of tabs 412) can be attached over the hopper inlet 402, such as those commonly known to those having skill in the art and shown in FIG. 2C. Accordingly, the alignment ring 300 does not interfere with the inlet 402 itself where it is positioned around the inlet 402 of the hopper 400 and merely engages the annular collar of the hopper 400. Other types of hopper inlet covers could be used in combination with the alignment ring 300 and pod device described herein or a player may elect to remove the hopper inlet cover all together.

The pod 100 is made up of a body 101 and an outlet 102 and preferably has a tubular shape with a circular outlet 102, as shown in FIG. 1A, and preferably has a diameter that is approximately equal to the diameter of the hopper inlet 402. However, as with the inlet 402, the pod 100 and outlet 102 may take other shapes that effectively operate to deliver paintballs into a paintball hopper 400. In operation, the pod 100 has a filling orientation and a disengaged orientation removed from the hopper 400 of the paintball gun. During the reloading process, the player takes the pod 100 from their harness and, in one implementation, moves it into the filling orientation, shown in FIG. 1B, where the annular collar 200 engages with the alignment ring 300 attached to the hopper 400, as described herein.

In another aspect of the filling device described herein, the annular collar 200 is attached around the outlet 102 of the pod 100 and a valve 250 is positioned over the pod outlet 102. Along with a valve body 250 that opens and closes, the annular collar 200 has a housing 210 holding the ratchet mechanism 220 that preferably includes a locking magnet 240 that catches against multiple ratchet teeth 222 positioned on an annular ratchet 220. Additionally, an array of magnets 245 that engage the magnets 310 in the alignment ring 300 may also be positioned in the housing 210 of the annular collar 200. The valve 250 has an interior body and an exterior perimeter attached to the annular ratchet 220 particularly shown in FIGS. 3F-3G.

As described above, the magnets 245 in the annular collar 200 engage the array of magnets 310 in the alignment ring 300. Thus, the collar 200 and alignment ring 300 automatically align the pod outlet 102 with the hopper inlet 402 during the reloading process. In addition to aligning the pod 100 and hopper 400, the operative connection between the ring 300 and collar 200 activates the valve 250 and releases the locking magnet 240 causing the valve 250 to open. Accordingly, the valve 250 has an open position, shown in FIG. 3G, allowing paintballs to pass through the pod outlet 102 and a closed position, shown in FIG. 3F, where the paintballs are prevented from exiting through the outlet 102 of the pod 100.

In one implementation, when the pod 100 is moved into a filling orientation and the alignment ring 300 engages the annular collar 200, the magnets 310 in the alignment ring 300 align the annular collar 200 of the pod 100 over the inlet 402 of the hopper 400 and simultaneously unlock the valve 250 (e.g., simultaneously move the magnet(s) 240 to the second position 244, allowing the ratchet member 220 to more back, via a force from the spring(s) 260 or tension force applied by the elastic membrane 255, to the home position and open the valve 250). Accordingly, the valve 250 opens and paintballs are free to pass through the outlet 102 of the pod 100 into the hopper 400. Although the size and position of the magnets 310 may vary, the preferred embodiment includes an array of magnets 310 arranged within the alignment ring 300. Similarly, corresponding magnets 245 are within the annular collar 200 that attract to the magnets 310 within the alignment ring 300. However, in one implementation the magnets 245 within the annular collar 200 are positioned such that they do not interact with the locking magnet 240 which is attracted to the ferrous plate 230 in the disengaged orientation and removed from the ferrous plate 230 and attracted to the magnets 310 in the alignment ring 300 in the filling orientation. Alternatively, an array of locking magnets 240 may double as both the locking mechanism catch and the magnets that align the pod 100 with the inlet 402 of the hopper 400. Accordingly, the second array of magnets 245 within the annular collar may be replaced all together.

When in the closed position, the valve 250 is biased towards the open position but is prevented from opening by the locking magnet 240 that catches against a tooth 222 of the annular ratchet 220 within the housing 210 of the collar 200. Preferably, the valve body 250 is made from an elastic material, such as elastane or latex, where the valve 250 is under tension such that the tension causes the valve 250 to spiral open when the locking magnet 240 is released. After the valve 250 is opened and the hopper 400 is filled, the player must refill the pod 100 with paintballs and reset the valve 250 (e.g., by rotating the ratchet member 220 so that the teeth 222 pass under and engage the magnet(s) 240 to close the valve 250 and keep the ratchet member 220 from moving to the home position and opening the valve 250) such that the valve 250 is again under tension. Accordingly, the exterior perimeter of the valve body 250 is attached to the annular ratchet 220 wherein rotating the ratchet mechanism 220 closes and locks the valve 250.

Figure 3A:
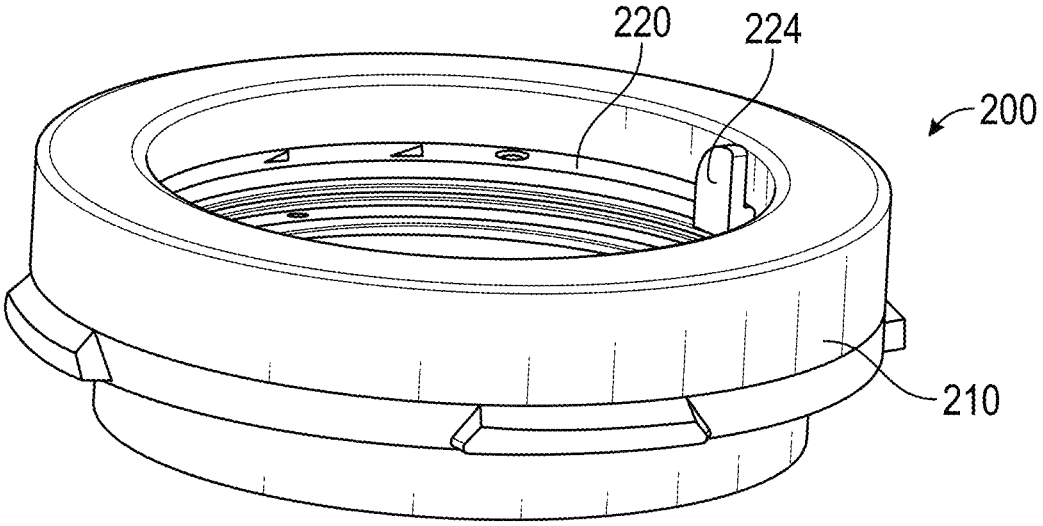
FIG. 3A shows a perspective view of an annular collar of the pod.
Figure 3B:
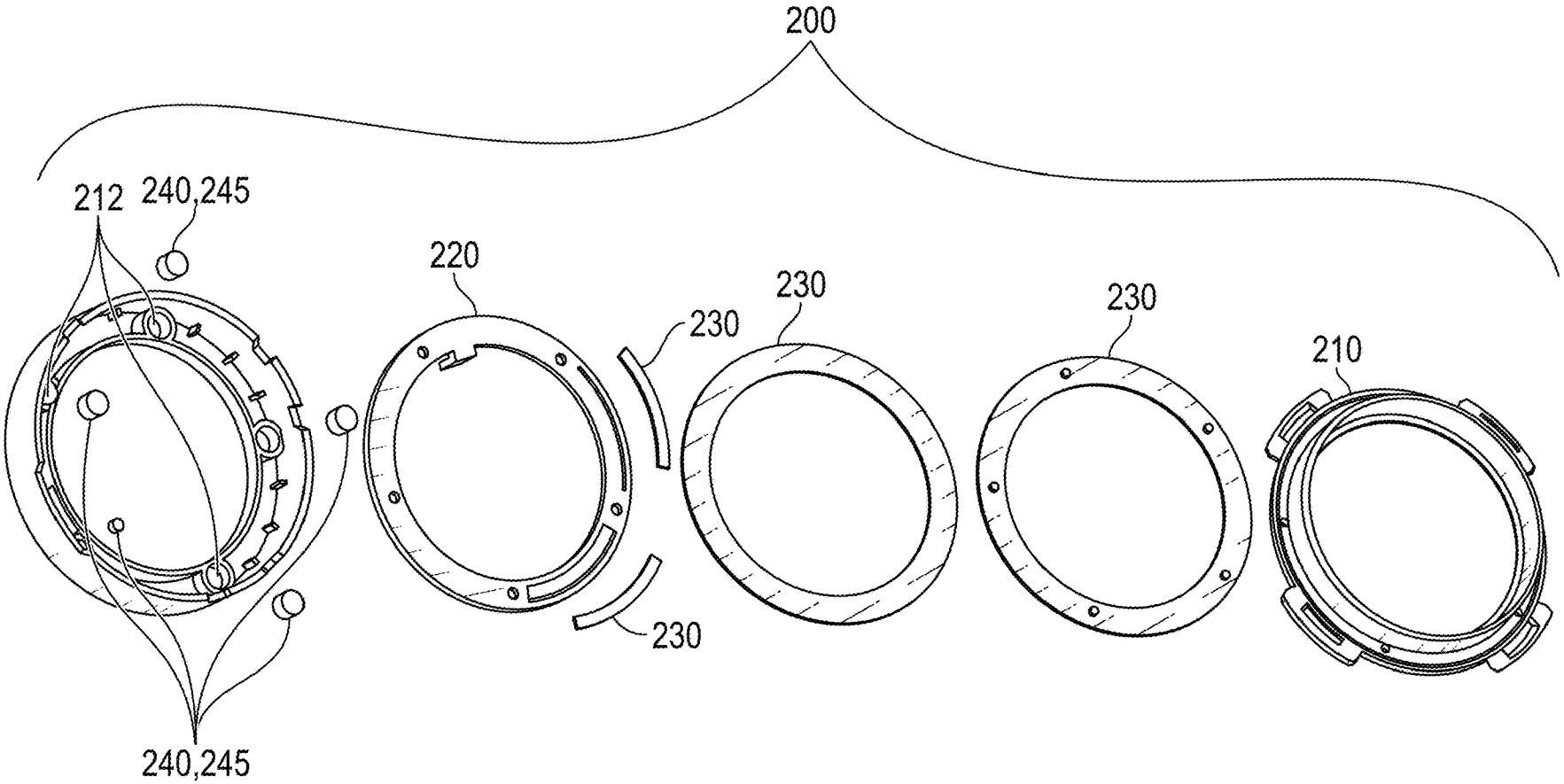
FIG. 3B is an exploded view of the annular collar of the pod.
Figure 3C:
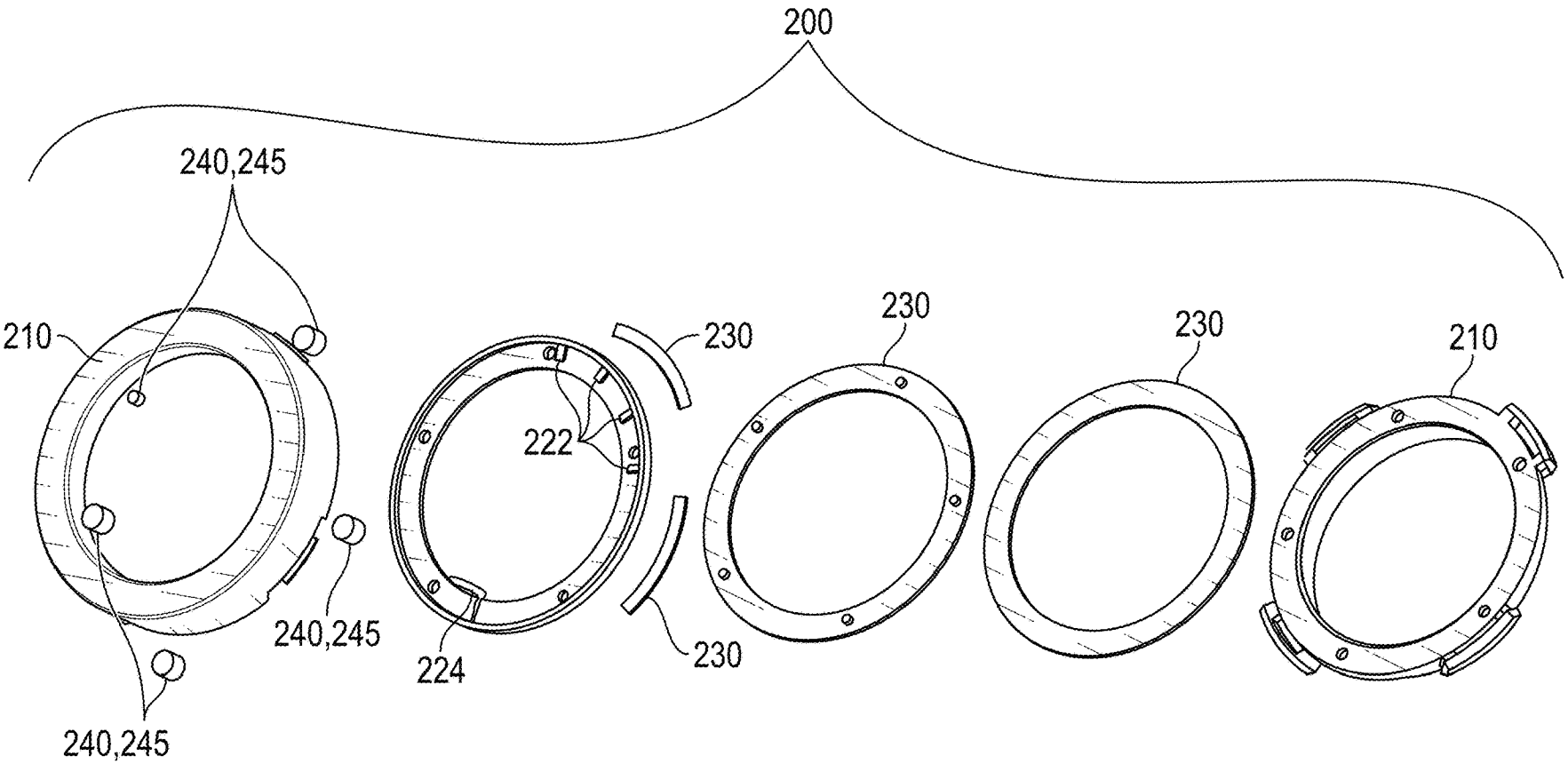
FIG. 3C is a reverse exploded view of the annular collar of the pod.
Figure 3D:
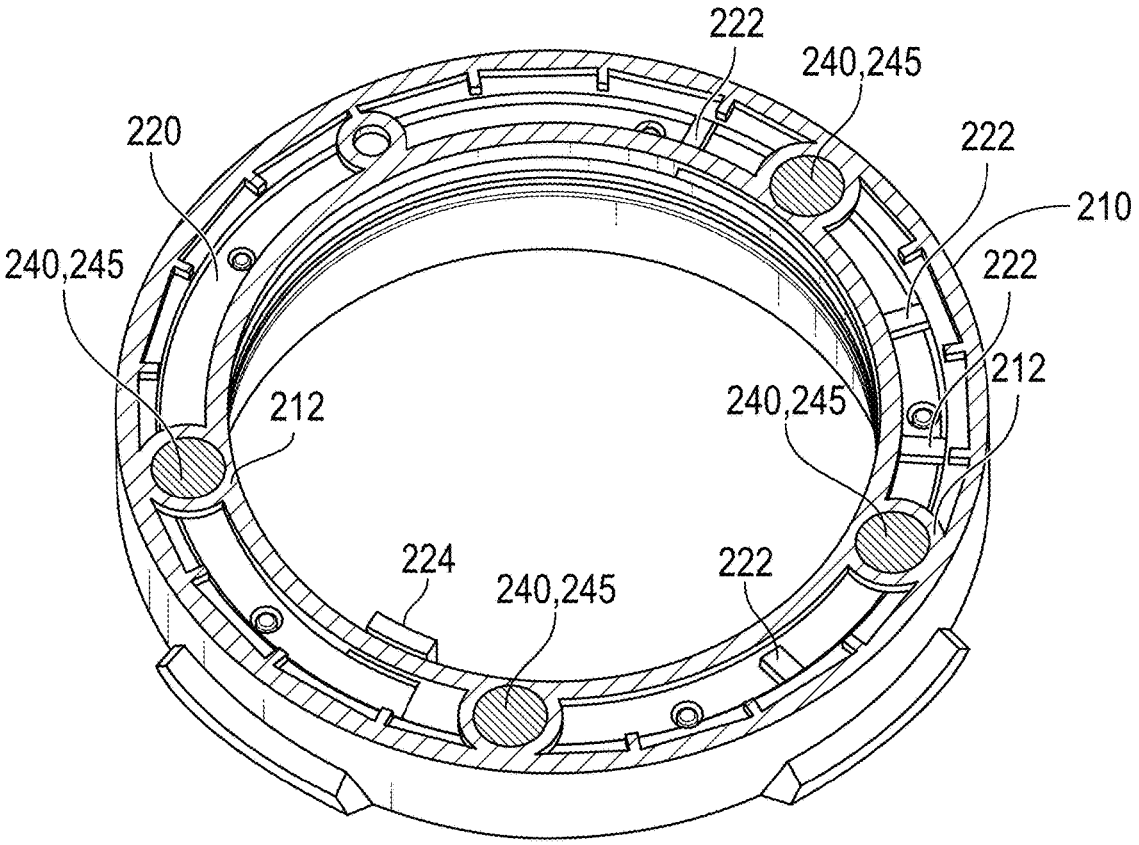
FIG. 3D is a partial cross-sectional view of the annular collar of the pod along line 3D-3D in FIG. 3E.
Figure 3E:
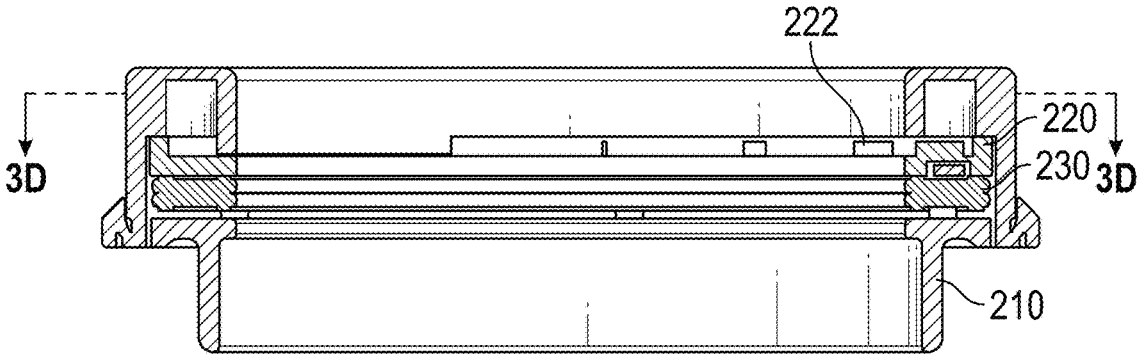
FIG. 3E is a partial cross-sectional view of the annular collar of the pod.
Figure 3F:
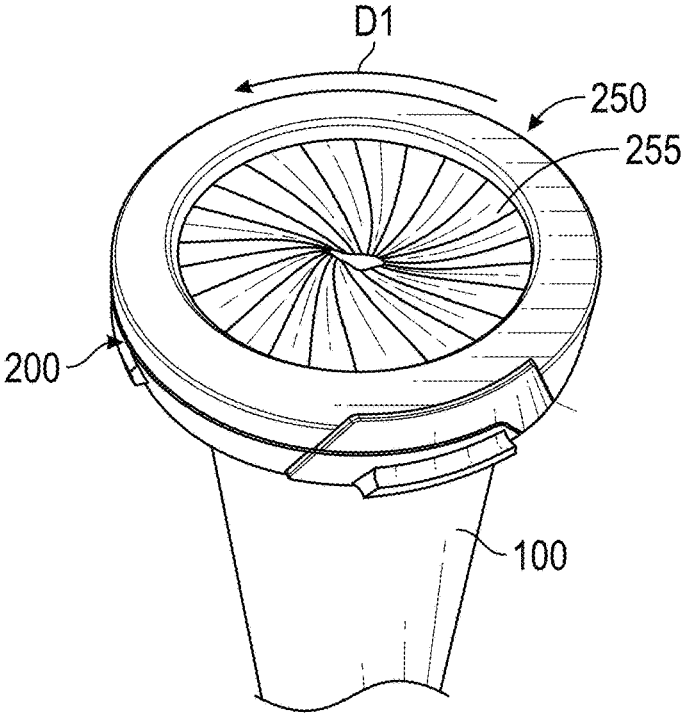
FIGS. 3F and 3G illustrate perspective views of the valve in the open position and the closed position, respectively.
Figure 3G:
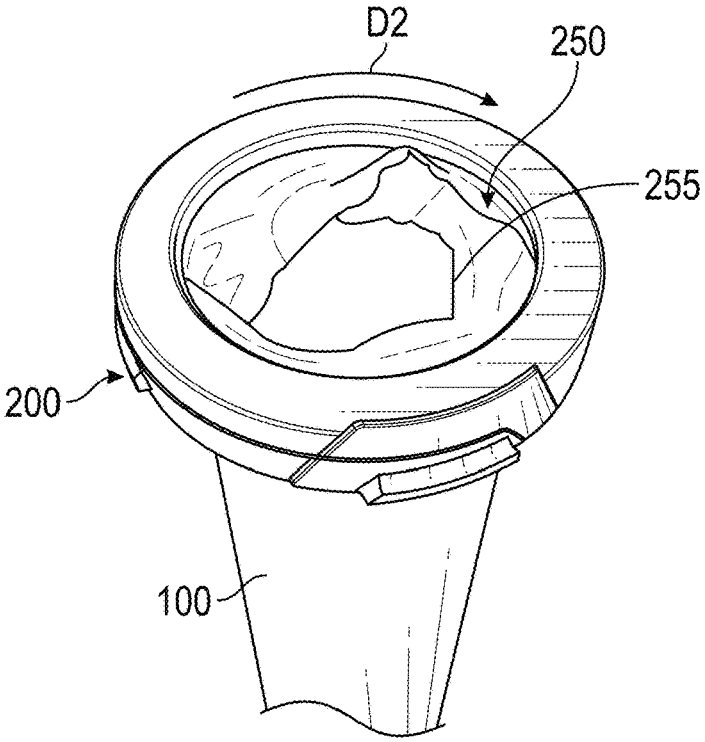

As shown in FIGS. 3B and 3C, in one implementation the valve 250 has a single elastic body membrane 255 with the outer perimeter being attached to the ratchet mechanism 220 and an interior portion that opens and closes like an iris diaphragm. In operation, the circular membrane 255 overlaps into a position that is taunt and under tension when the valve 250 is closed and locked, as shown in FIG. 3F. Subsequently, when the lock (e.g., magnet(s) 240) is disengaged the membrane 252 loosens and the center opening in the center of the body 250 widens and allows paintballs to pass there through, as shown in FIG. 3G.

In some implementations, the annular collar 200 can have a quick release lever or button (e.g., slidable lever, depressible button) 270 that can be actuated by a user to open the valve 250, for example, before the pod 100 is aligned with the inlet opening 402 of the hopper 400. The quick release lever or button 270 can actuate (e.g., contact, bear upon) the magnet(s) 240 to move them to the second position 244 away from the ratchet member 220, allowing the valve 250 to move to the open position (e.g., by the tension force in the membrane 255 that biases the ratchet member 220 toward the home position). In such an implementation, the user can open the valve 250 without aligning the pod 100 over the hopper 400, and then dispense the paintballs from the pod 100 into the hopper 400. Accordingly, in this implementation, the alignment ring 300 can be excluded. The user can align the annular collar 200 with the inlet opening 402 of the hopper 400 and actuate the quick release lever or button 270 to open the valve 250 and dispense the paintballs from the pod 100 into the hopper 400.

Figure 4A:
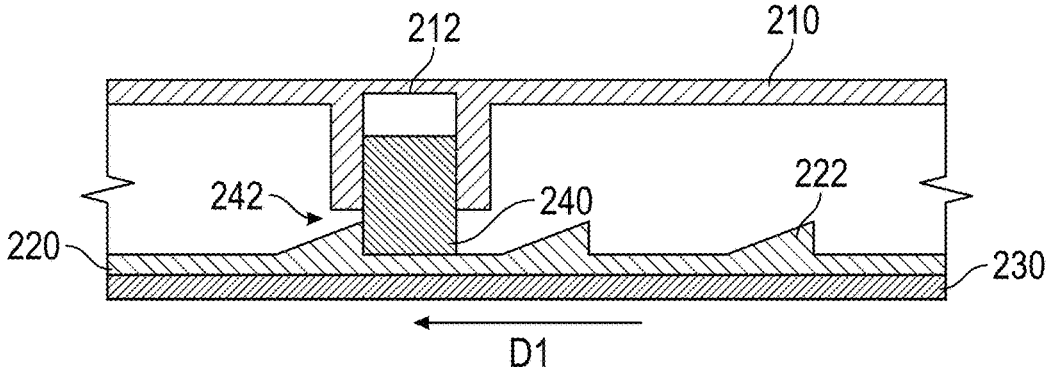
FIGS. 4A-4D illustrate schematic views of the operation of the annular collar.
Figure 4B:
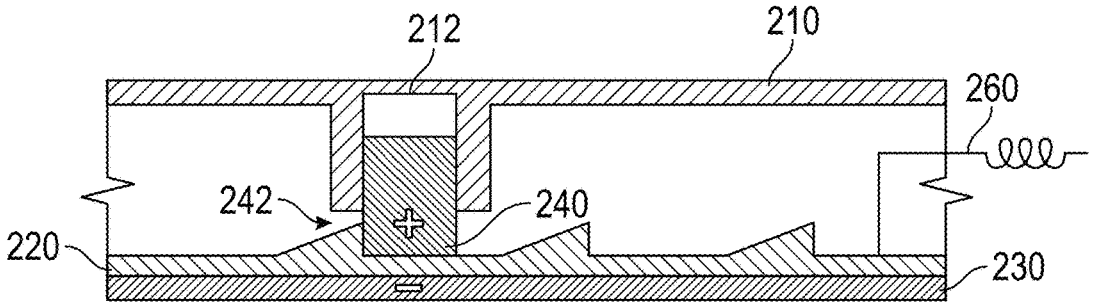
Figure 4C:
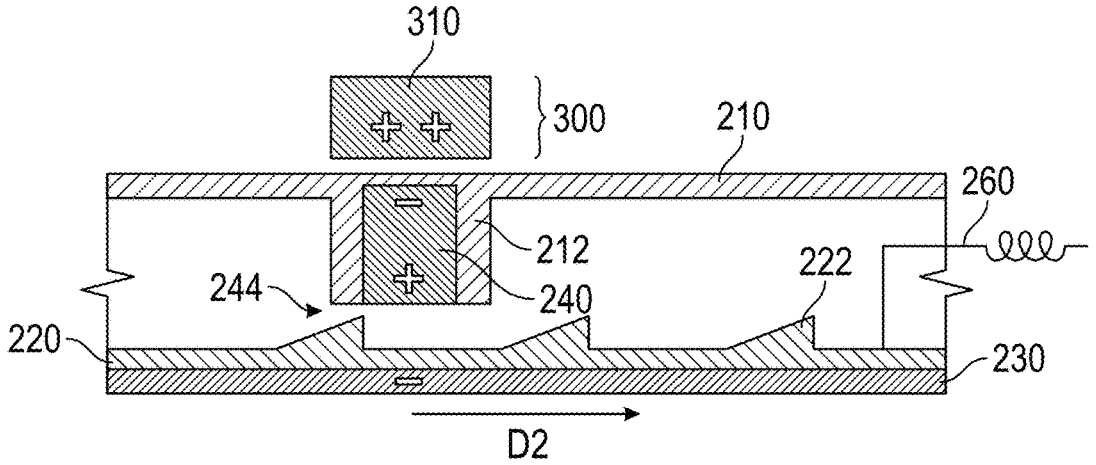
Figure 4D:
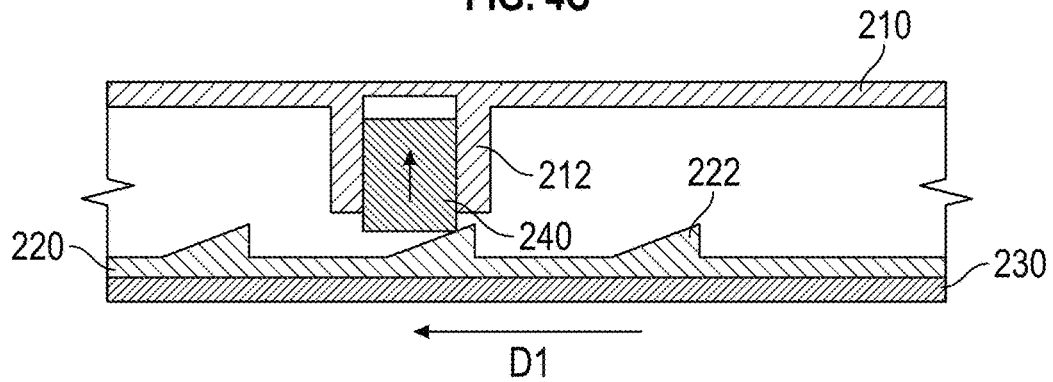
Figure 5A:
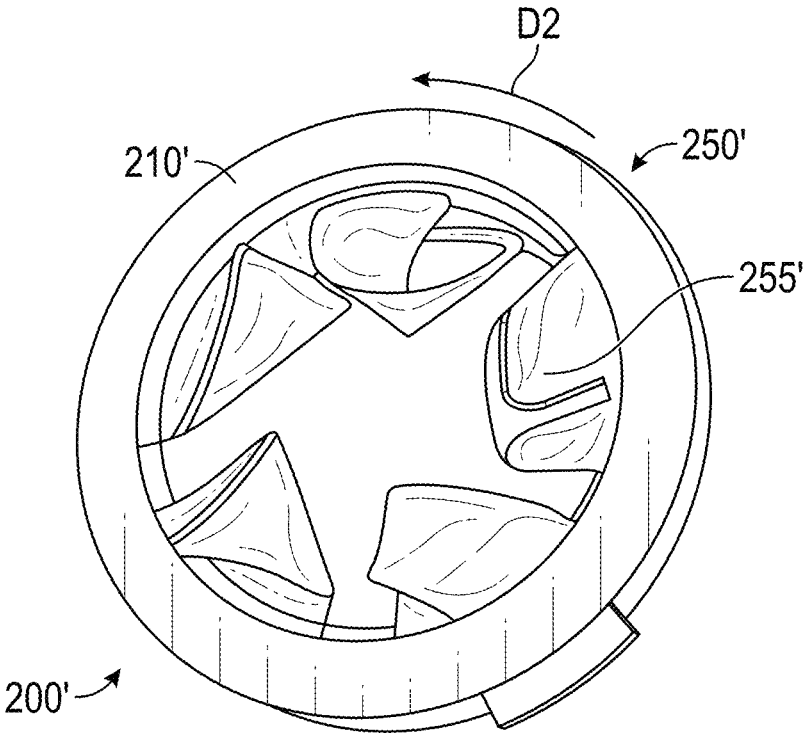
FIGS. 5A-5D depict another annular collar for a pod with a valve mechanism.
Figure 5B:
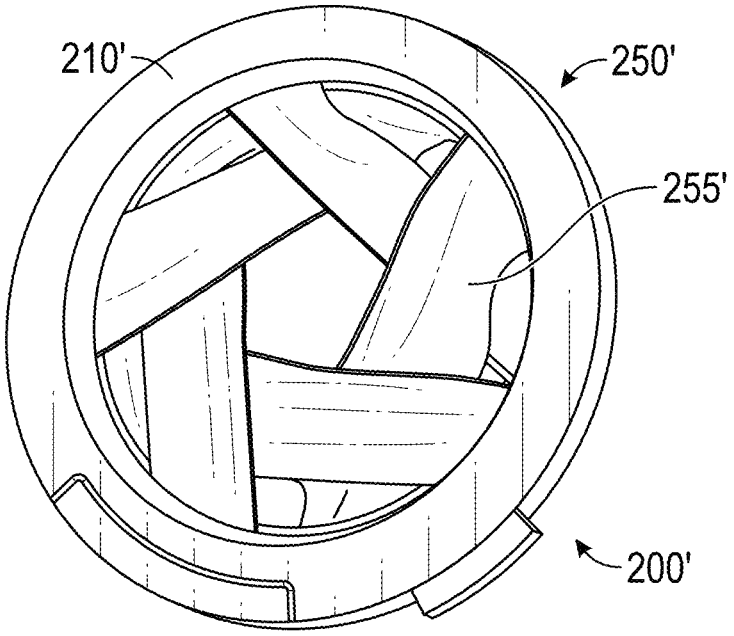
Figure 5C:
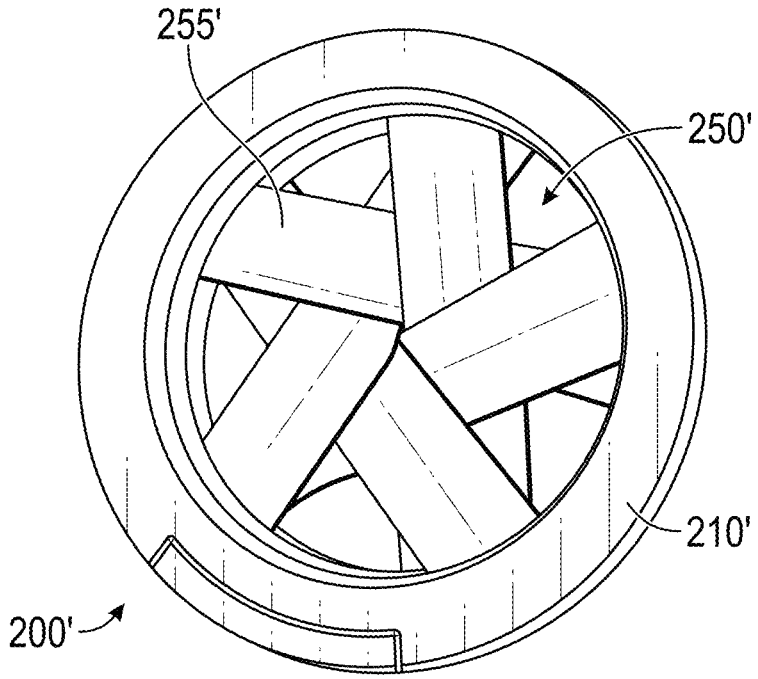
Figure 5D:
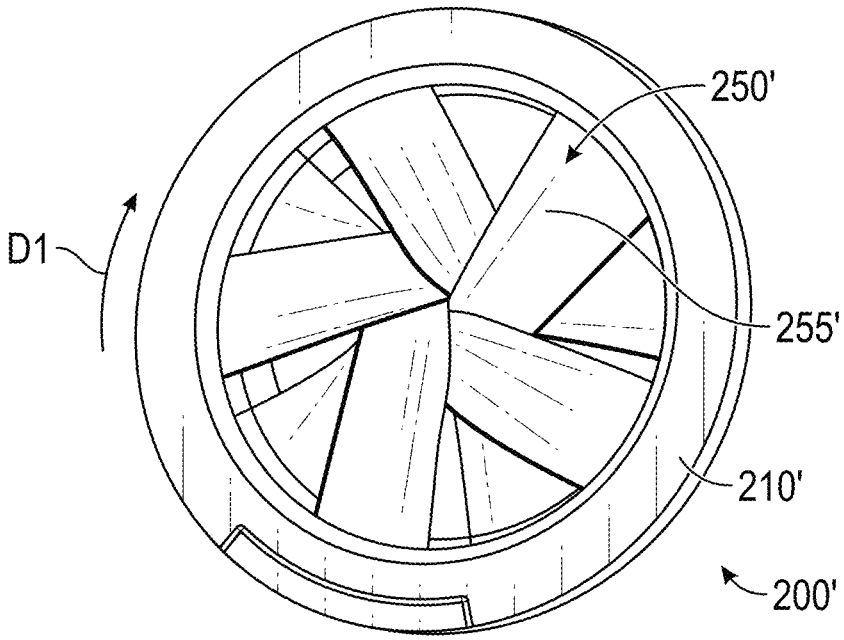

FIGS. 5A-5D illustrates an annular collar 200' with a valve 250' that can be attached to or incorporated in a pod, such as the pod 100. Some of the features of the annular collar 200' and valve 250' are similar to features of the annular collar 200 and valve 250 in FIGS. 1A-4D. Thus, references numerals used to designate the various components of the collar 200' and valve 250' are identical to those used for identifying the corresponding components of the collar 200 and valve 250 in FIGS. 1A-4D, except that a "'" has been added to the numerical identifier. Therefore, the structure and description for the various features of the collar 200 and valve 250 in FIGS. 1A-4D are understood to also apply to the corresponding features of the collar 200' and valve 250' in FIGS. 5A-5D, except as described below, The valve 250' differs from the valve 250 in that the valve 250' is an alternative iris valve that can include multiple elastic strips 255' of material rather than a single membrane. The strips 255' do not protrude from the collar 200' (e.g., from a surface of the collar 200' that faces the hopper 400 when the paintball pod 100 is aligned with the inlet opening 402 of the hopper 400). When the valve 250' is in the closed position, the strips 255' can extend generally transverse (e.g., perpendicular) to an axis of the paintball pod 100. The valve 250' remains an iris diaphragm and effectively operates in the same manner as the single membrane valve 250 described above. However, instead of a perimeter edge of a single membrane being connected to a periphery of the ratchet member 220, the ends of each strip 255' are connected to varying points on the ratchet member 220, and opposite ends of the strip(s) 255' are coupled to the housing 210'. Accordingly, when the valve 250' is set the strips 255' are put under tension and overlap, as shown in FIGS. 5A-5C, until the valve 250' is closed (e.g., in direction D1), as shown in FIG. 5D. When the valve 250' is unlocked (e.g., when the magnet(s) 240 are moved away from the ratchet member 220), the tension in the body of the valve 250' (e.g., tension in the elastic strip(s) 255' that have been stretched when the valve 250' is closed) causes the valve 250' to spiral open (e.g., in direction D2, see FIG. 5A) and the paintballs are dispensed. As seen in this implementation, the valve 250' with multiple strips 255', when in the "closed" position, may still have openings, but the size of the openings are smaller than a size of the paintballs in the pod 100, thereby inhibiting (e.g., preventing) the paintballs from being dispensed from the pod 100 when the valve 250' is closed.

Figure 6A:
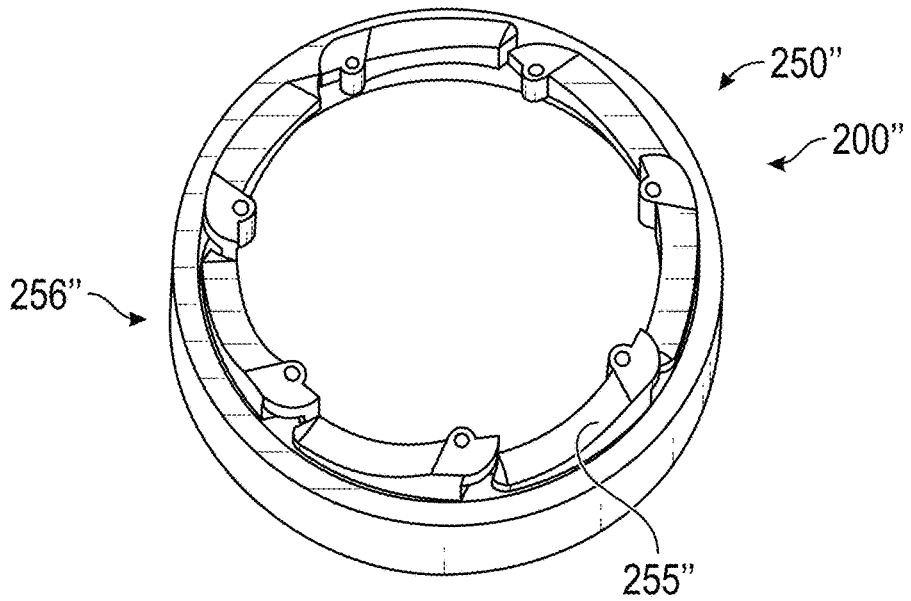
FIGS. 6A-6C illustrate another annular collar for a pod with a valve mechanism.
Figure 6B:
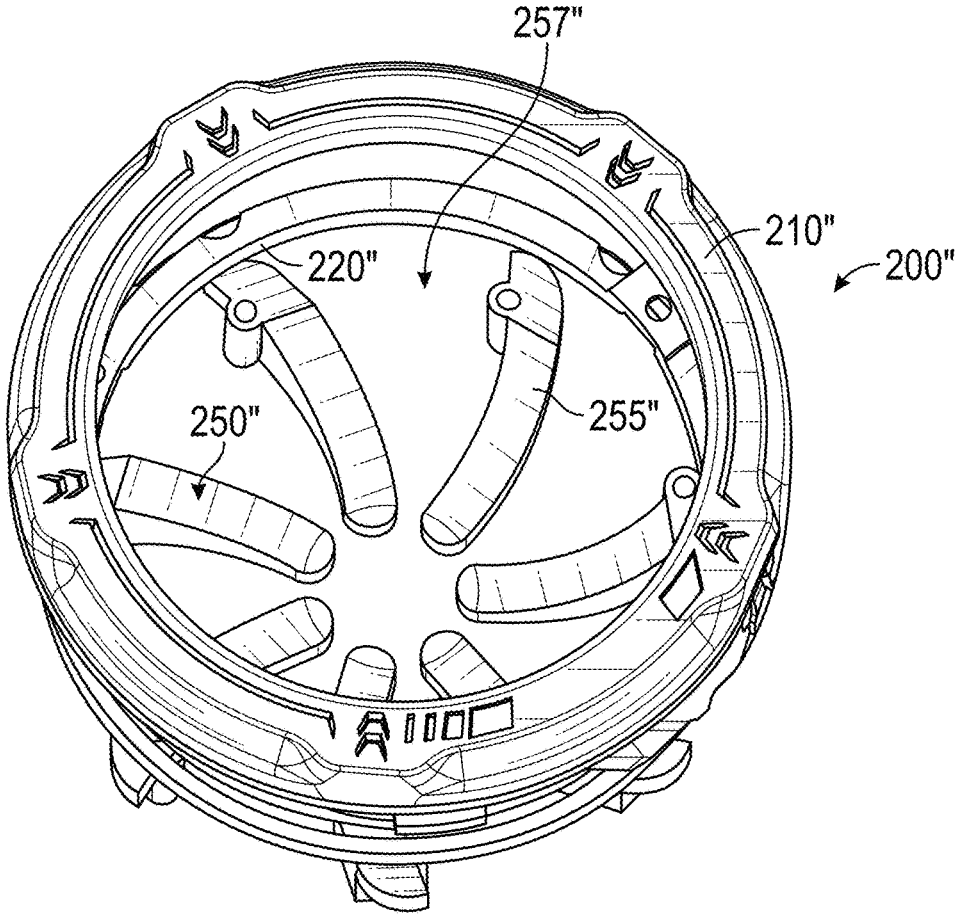
Figure 6C:
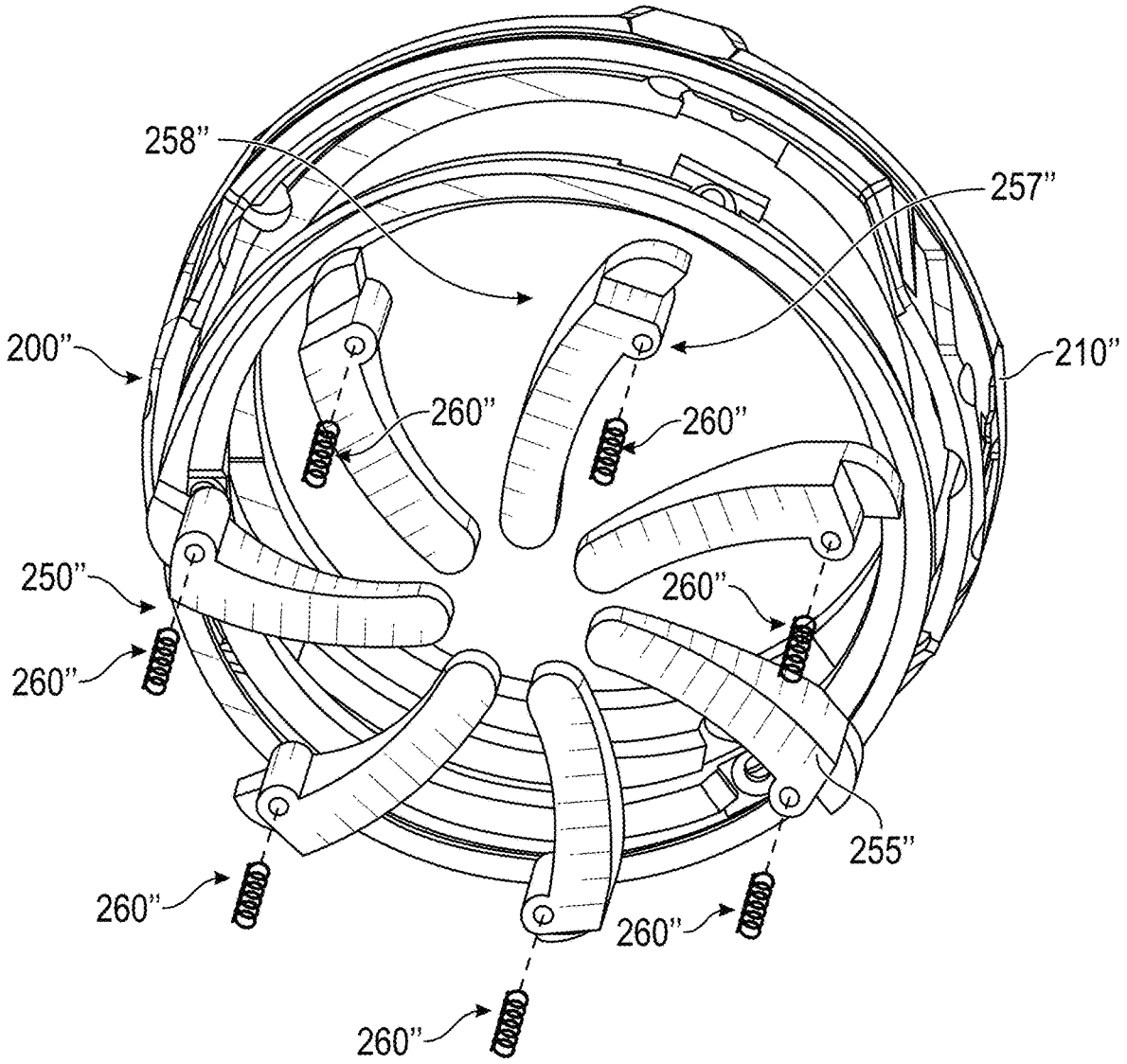

FIGS. 6A-6C illustrates an annular collar 200" with a valve 250" that can be attached to or incorporated in a pod, such as the pod 100. Some of the features of the annular collar 200" and valve 250" are similar to features of the annular collar 200' and valve 250' in FIGS. 5A-5D. Thus, references numerals used to designate the various components of the collar 200" and valve 250" are identical to those used for identifying the corresponding components of the collar 200' and valve 250' in FIGS. 5A-5D, except that a "" has been added to the numerical identifier. Therefore, the structure and description for the various features of the collar 200' and valve 250' in FIGS. 5A-5D are understood to also apply to the corresponding features of the collar 200" and valve 250" in FIGS. 6A-6C, except as described below.

The annular collar 200" and valve 250" differ from the collar 200' and valve 250' in that multiple finger members 255" are used instead of strips 255' to open and close the valve 250". Each of the finger members 255" is rotatably coupled to the housing 210" and can rotate between a retracted position 256" (see FIG. 6A) to open the valve 250" and an extended position 257" (see FIG. 6B) to close the valve 250". In the retracted position 256", the finger members 255" uncover at least a portion of the outlet opening 102 of the pod 100 to allow paintballs in the pod 100 to be dispensed (e.g., into the hopper 400). In the extended position 257", the finger members 255" cover at least a portion of the outlet opening 102 of the pod 100 to inhibit (e.g., prevent) paintballs in the pod 100 from being dispensed through the opening 102. Though there are open areas 258" between the finger members 255" when in the extended position 257", such open areas 258" are smaller than an outer dimension of the paintballs, thereby inhibiting (e.g., preventing) the paintballs from passing through the open areas 258".

Each of the finger members 255" can be biased toward the retracted position 256" by a tension force exerted, for example, by a spring 260" (e.g., a coil spring coupled to the finger member 255" and the housing 210"). The ratchet member 220" can be rotated so that teeth bear against the finger members 255" to move them into the extended position 257" against a biasing force from the spring 260". One or more locking members 240" (e.g., magnet(s) 240") can bear against the teeth to inhibit (e.g., prevent) the ratchet member 220" from rotating in an opposite direction to a home position and allowing the finger members 255" to move back to the retracted position 256". The locking members (e.g., magnet(s)) can be moved (e.g., slid withing openings in the housing 210") to the second position away from the ratchet member 220", such as by generally aligning the collar 200" with the alignment ring 300 on the hopper 400, allowing the ratchet member 220" to move back to the home position and the tension force (from the springs 260") to move the finger member(s) 255" to the retracted position 256".

Figure 3H:
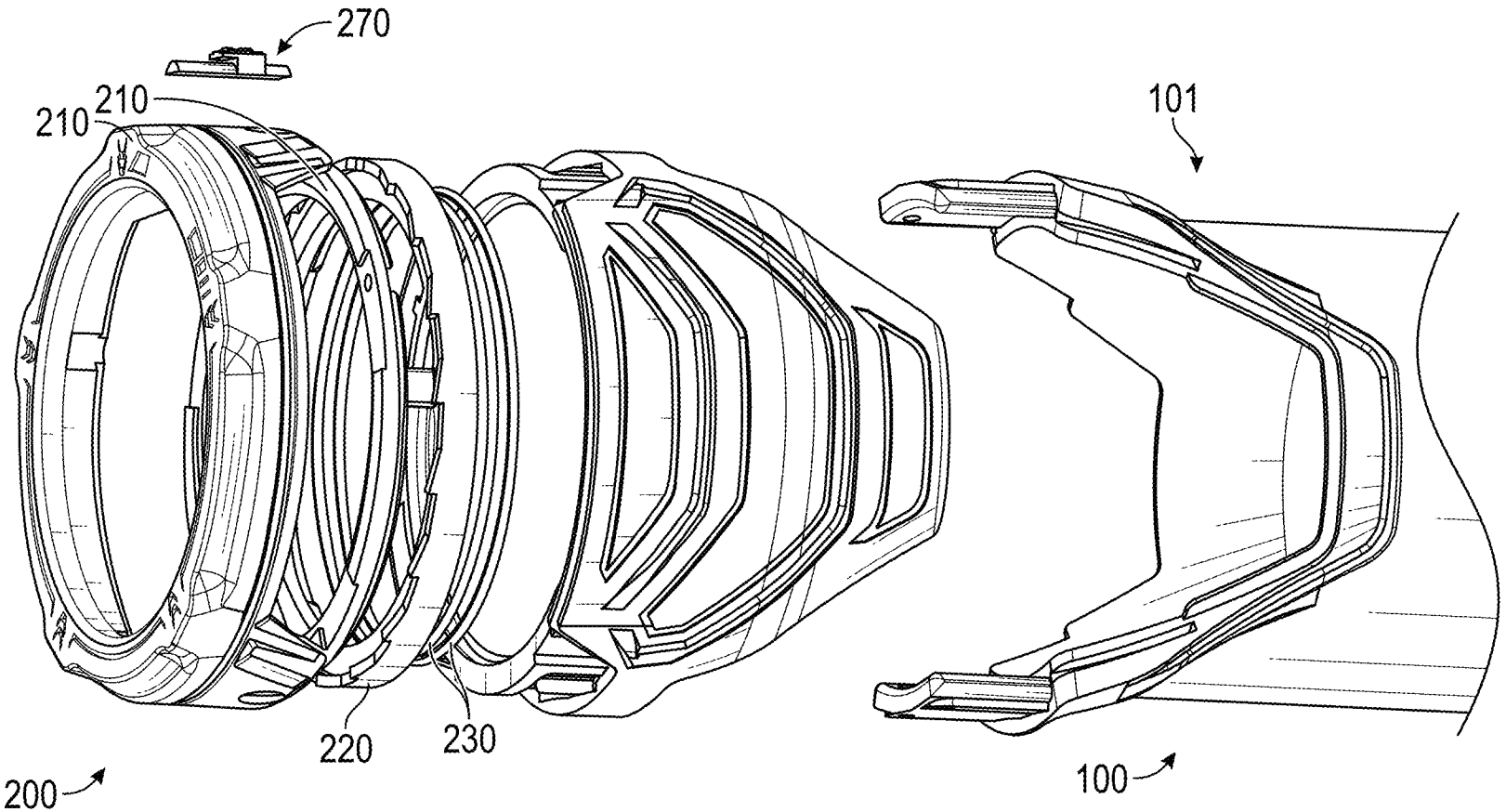
FIG. 3H illustrate a perspective exploded view of an annular collar for a paintball pod.

Optionally, the collar 200" can have a quick release lever or button (e.g., slidable lever, depressible button, similar to button 270" in FIG. 3H) that can be actuated by a user to open the valve 250", for example, before the pod 100 is aligned with the inlet opening 402 of the hopper 400. The quick release lever or button can actuate (e.g., contact, bear upon) the magnet(s) 240" to move them to the second position 244" away from the ratchet member 220", allowing the valve 250" to move to the open position (e.g., by the tension force of the springs 260" on the finger member(s) 255"). In such an implementation, the user can open the valve 250" without aligning the pod 100 over the hopper 400, and then dispense the paintballs from the pod 100 into the hopper 400. Accordingly, in this implementation, the alignment ring 300 can be excluded. The user can align the annular collar 200" with the inlet opening 402 of the hopper 400 and actuate the quick release lever or button to open the valve 250" and dispense the paintballs from the pod 100 into the hopper 400.

Advantageously, the annular collar 200, 200', 200" has a low profile and allows the opening of the valve 250, 250', 250" and dispensing of paintballs from the pod 100 irrespective of the angular orientation of the pod 100 relative to the hopper 400. For example, unlike in conventional pods, a user does not need to pay attention to the location the lid of the pod is in or the direction in which the lid will open, and therefore can maintain focus on the game while filling or refilling the hopper 400 with paintballs from the pod 100.

Although the body of the valve 250, 250' is preferably made from an elastic material biasing the valve 250, 250' towards the open position when under tension, it will be appreciated by those having an ordinary skill in the art that other biasing mechanisms, such as a mechanical assembly (e.g., finger members 255"), and valve configurations can be used such that the valve opens when a continuous magnetic force engages the locking magnet (e.g., magnet(s) 240) within the annular collar (e.g., collar 200). A spring 260, 260" may be used in a mechanical assembly to move the valve 250, 250" between the open and the closed position. For example, the preferred MUCON™ iris diaphragm valve may be replaced with a mechanical valve that may include a spring 260" or similar biasing member. Additionally, other materials could be used in place of an elastic valve body. Although the preferred iris valve (e.g., membrane 255, strips 255') is made of an elastic material, other iris valves may have plates, strips, fingers or blades that move between an open and closed position.

With reference to the annular collar 200, 200', in one implementation a ratchet catch within the housing 210 of the annular collar 200 is a magnet 240 (or plurality of magnets 240) having a locked position where the magnet 240 locks against the teeth 222 of the annular ratchet member 220, such as shown in FIG. 4A and FIG. 4B. When the valve 250, 250' is locked and closed (e.g., inhibits or prevents paintballs from being dispensed from the pod 100), the magnet 240 is attracted to a ferrous plate 230 within the annular collar 200 and the valve 250, 250' is under tension.

However, it will also be appreciated that in other implementations the annular ratchet member 220 itself may be a ferrous material and thereby replace the ferrous plate 230. In either embodiment the magnet 240 can be unlocked by applying a continuous magnetic force to the annular collar 200 such that magnetic force is greater than the attraction between the magnet 240 and the ferrous plate 230 or ferrous annular ratchet member 220. When the magnetic force is applied, such as when the pod 100 is in the filling orientation, the magnet 240 moves away from the ferrous material 230 and the catch (e.g., magnet 240) disengages from the teeth 222 of the annular ratchet member 220, allowing the valve 250, 250' to spiral open, as shown in FIG. 4C, and allow the dispensing of paintballs from the pod 100 via the outlet opening 102.

To set and close the valve 250, 250', the player need only rotate the ratchet member 220 until the elastic body of the valve 250, 250' is stretched and under tension. To ease players in setting the valve 250, 250', a tab 224 protrudes from the side of the annular collar 200 to allow a player to rotate the ratchet member 220 and move the valve 250, 250' into the closed position, as shown in FIG. 1A and FIG. 3F. As the ratchet member 220 rotates, the locking magnet catch (e.g., magnet(s) 240) rides over the backside (e.g., inclined side) of the ratchet teeth 222 and is attracted to the ferrous plate 230 as it passes over the respective teeth 222, locking the valve 250, 250', such as shown in FIG. 4D. Accordingly, the ratchet teeth 222 and catch 240 keep the valve 250, 250' from opening while the unit is being closed. The ratchet teeth 222 and catch 240 also help keep the unit closed if the pod 100 is dropped, or acted upon by external forces. Because of the constant tension created by the elastic material (e.g., of the single membrane 255 or strips 255'), the valve 250, 250' when closed, wants to spin back to its original open position.

To facilitate easy use by the player, the alignment ring 300 and annular collar 200 can automatically align the pod 100 and hopper 400 and thereby remove the need for fine motor skills during the high stress situation of reloading a paintball hopper during play. In one implementation, the valve 250, 250', 250" can open (e.g., only opens) once it is in the proper orientation, which ensures all the paintballs in the pod 100 enter the hopper 400 and prevents spilling and waste of paintballs that is common in existing hopper filling systems. The system also allows a single action to reload on the field and thereby shaves time off a process that generally makes all players extremely vulnerable. Additionally, in one implementation, the integrated ratchet system (e.g., ratchet member 220) provides a failsafe by requiring the presence of a continuous magnetic force to unlock the valve 250, 250' past the multiple teeth 222, which ensures the unit will retain its paintballs if dropped or acted on by external forces. For example, if the pod 100 is dropped and the locking magnet catch 240 shifts, it may only move past a single tooth 222 before moving back to the locked position by its attraction ferrous plate 230.

It should be generally understood that an aspect of the pod 100 described herein is to be light weight and durable. As with pods 100 having traditional flip top or other common closures, a paintball player may carry eight or more pods without being hampered by the improved valve 250, 250', 250" atop the outlet 102 of the pod 100. The improved paintball filling system advantageously includes a lightweight pod 100 and collar 200 and a lightweight and low profile alignment ring 300 that can be mounted or integrated with the hopper 400 without noticeably altering the weight, shape or overall function of the hopper 400. Additionally, the annular collar 200 and alignment ring 300 can advantageously be incorporated into existing pods 100 and hoppers 400. With a removable valve 250, 250', a player can replace the pod 100 or hopper 400 without necessarily having to replace the entire valve 250, 250' and alignment ring 300. However, it will also be appreciated that the valve 250, 250' and alignment ring 300 may be integrated (e.g., one-piece) with the pod 100 and hopper 400, respectively.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. An assembly for dispensing paintballs from a paintball pod into a paintball hopper, comprising:

a collar configured to be disposed at a proximal end of a paintball pod about an outlet opening of the paintball pod, the collar comprising:

an annular housing having a central opening centered on a central axis of the annular housing and that aligns with the outlet opening of the paintball pod, an annular ratchet member rotatably coupled to the annular housing and having a central aperture that aligns with the central opening, a valve coupled to the annular ratchet member, the valve having one or more valve members configured to at least partially extend into the central aperture in a direction generally transverse to the central axis and cover at least a portion of the outlet opening to inhibit paintballs from passing therethrough when the annular ratchet member rotates in a first direction relative to the annular housing, the one or more valve members configured to at least partially retract from the central aperture and uncover at least a portion of the outlet opening to allow paintballs to pass therethrough when the annular ratchet member rotates in a second direction opposite to the first direction, wherein the annular ratchet member is configured to rotate in the second direction relative to the paintball hopper and the paintball pod to allow paintballs to exit the paintball pod through the outlet opening.

2. The assembly of claim 1, wherein the ratchet member is biased toward a home position where the valve is open by a tension force.

3. The assembly of claim 1, further comprising one or more movable lock members that releasably engage one or more teeth of the ratchet member, the lock members movable between an engaged position with the teeth to retain the valve closed and inhibit rotation of the ratchet member to a home position where the valve is open and a retracted position spaced apart from the teeth to allow the ratchet member to rotate to the home position where the valve is open.

4. The assembly of claim 3, wherein the one or more lock members are one or more magnets, wherein a first magnetic force draws the one or more magnets toward the ratchet member and into the engaged position with the teeth, and a second magnetic force draws the one or more magnets away from the ratchet member.

5. The assembly of claim 4, further comprising one or more ferrite plates disposed on an opposite side of the ratchet member from the one or more lock magnets, the first magnetic force exerted between the one or more ferrite plates and the one or more magnets.

6. The assembly of claim 4, further comprising an alignment ring attached to a paintball hopper about an inlet opening of the paintball hopper, the alignment ring comprising one or more magnets configured to exert the second magnetic force on the one or more lock members to retract the lock members relative to the ratchet member and allow the valve to automatically open when the collar is operatively aligned with the alignment ring such that the aperture generally aligns with the inlet opening of the paintball hopper, allowing paintballs to be dispensed from the paintball pod into the paintball hopper.

7. The assembly of claim 1, wherein the one or more valve members is a single membrane, the membrane having one end coupled to the ratchet member and an opposite end coupled to the annular housing.

8. The assembly of claim 7, wherein the single membrane is made of an elastic material, wherein a tension force on the elastic material increases as the ratchet member is rotated in the first direction to close the valve, the tension force configured to bias the ratchet member toward a home position where the valve is open.

9. The assembly of claim 1, wherein the one or more valve members are a plurality of strips of elastic material having one end coupled to the ratchet member and an opposite end coupled to the annular housing, wherein a tension force on the elastic material increases as the ratchet member is rotated in the first direction to close the valve, the tension force configured to bias the ratchet member toward a home position where the valve is open.

10. The assembly of claim 1, wherein the one or more valve members are a plurality of finger members configured to move from a retracted position to uncover at least a portion of the outlet opening to allow paintballs to pass therethrough and a deployed position to cover at least a portion of the outlet opening and disallow paintballs to pass therethrough.

11. The assembly of claim 10, wherein each of the finger members is rotatably coupled to the housing and biased toward the retracted position by a spring interposed between the finger member and the annular housing.

12. The assembly of claim 1, further comprising a lever manually actuatable by a user that, when actuated, allows the annual ratchet member to rotate in the second direction.

13. An assembly for dispensing paintballs from a paintball pod into a paintball hopper, comprising:

a collar configured to be disposed at a proximal end of a paintball pod about an outlet opening of the paintball pod, the collar comprising:

an annular housing having a central opening centered on a central axis of the annular housing and that aligns with the outlet opening of the paintball pod, an annular ratchet member rotatably coupled to the annular housing and having a central aperture that aligns with the central opening, a valve coupled to the annular ratchet member, the valve having one or more valve members configured to at least partially extend into the central aperture in a direction generally transverse to the central axis and cover at least a portion of the outlet opening to inhibit paintballs from passing therethrough when the annular ratchet member rotates in a first direction relative to the annular housing, the one or more valve members configured to at least partially retract from the central aperture and uncover at least a portion of the outlet opening to allow paintballs to pass therethrough when the annular ratchet member rotates in a second direction opposite to the first direction; and an alignment ring configured to be disposed over paintball hopper about an inlet opening of the paintball hopper, wherein the valve is actuatable to allow dispensing of paintballs through the collar and alignment ring and into the paintball hopper;

wherein the annular ratchet member is configured to rotate in the second direction relative to the paintball hopper and the paintball pod to allow paintball to exit the paintball pod through the outlet opening.

14. The assembly of claim 13, further comprising one or more movable lock members that releasably engage one or more teeth of the ratchet member, the lock members movable between an engaged position with the teeth to retain the valve closed and inhibit rotation of the ratchet member to a home position where the valve is open and a retracted position spaced apart from the teeth to allow the ratchet member to rotate to the home position where the valve is open.

15. The assembly of claim 14, wherein the one or more lock members are one or more magnets, wherein a first magnetic force draws the one or more magnets toward the ratchet member and into the engaged position with the teeth, and a second magnetic force draws the one or more magnets away from the ratchet member.

16. The assembly of claim 15, further comprising one or more ferrite plates disposed on an opposite side of the ratchet member from the one or more lock magnets, the first magnetic force exerted between the one or more ferrite plates and the one or more magnets.

17. The assembly of claim 16, wherein the alignment ring comprises one or more magnets configured to exert the second magnetic force on the one or more lock members to retract the lock members relative to the ratchet member and allow the valve to automatically open when the collar is operatively aligned with the alignment ring such that the aperture generally aligns with the inlet opening of the paintball hopper, allowing paintballs to be dispensed from the pod into the paintball hopper.

18. The assembly of claim 13, wherein the one or more valve members is a single membrane, the membrane having one end coupled to the ratchet member and an opposite end coupled to the annular housing, the single membrane made of an elastic material, wherein a tension force on the elastic material increases as the ratchet member is rotated in the first direction to close the valve, the tension force configured to bias the ratchet member toward a home position where the valve is open.

19. The assembly of claim 13, wherein the one or more valve members are a plurality of strips of elastic material having one end coupled to the ratchet member and an opposite end coupled to the annular housing, wherein a tension force on the elastic material increases as the ratchet member is rotated in the first direction to close the valve, the tension force configured to bias the ratchet member toward a home position where the valve is open.

20. The assembly of claim 13, wherein the one or more valve members are a plurality of finger members configured to move from a retracted position to uncover at least a portion of the outlet opening to allow paintballs to pass therethrough and a deployed position to cover at least a portion of the outlet opening and disallow paintballs to pass therethrough, each of the finger members being rotatably coupled to the housing and biased toward the retracted position by a spring interposed between the finger member and the annular housing.

* * * * *